US006278469B1

(12) United States Patent
Bland et al.

(10) Patent No.: US 6,278,469 B1
(45) Date of Patent: Aug. 21, 2001

(54) CUSTOMIZING PRINTMASKS FOR PRINTHEAD NOZZLE ABERRATIONS

(75) Inventors: William E Bland, Cardiff; Ronald A Askeland, San Diego, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/399,430

(22) Filed: Sep. 20, 1999

(51) Int. Cl.[7] ..... B41J 29/393
(52) U.S. Cl. ..... 347/19; 347/40; 347/41
(58) Field of Search ..... 347/9, 10, 11, 347/12, 14, 19, 40, 41

(56) References Cited

U.S. PATENT DOCUMENTS

| | | | | |
|---|---|---|---|---|
| 3,953,860 | | 4/1976 | Fujimoto et al. | 347/81 |
| 4,323,905 | | 4/1982 | Reitberger et al. | 347/6 |
| 4,922,270 | | 5/1990 | Cobbs et al. | 347/19 |
| 4,963,882 | * | 10/1990 | Hickman | 347/41 |
| 5,109,239 | | 4/1992 | Cobbs et al. | 347/19 |
| 5,124,720 | | 6/1992 | Schantz | 347/19 |
| 5,272,503 | | 12/1993 | LeSueur et al. | 399/25 |
| 5,434,430 | | 7/1995 | Stewart | 250/573 |
| 5,812,156 | | 9/1998 | Bullock et al. | 347/19 |
| 6,010,205 | * | 1/2000 | Billet | 347/40 |
| 6,050,675 | | 4/2000 | Bartolome | 347/41 |
| 6,174,039 | * | 1/2001 | Miyake et al. | 347/12 |

FOREIGN PATENT DOCUMENTS

| | | |
|---|---|---|
| 0694396A2 | 7/1995 | (EP) . |
| 00307428.3 | 12/2000 | (EP) . |

* cited by examiner

*Primary Examiner*—John Barlow
*Assistant Examiner*—Blaise Mouttet
(74) *Attorney, Agent, or Firm*—Robert C. Sismilich

(57) ABSTRACT

An inkjet printer and printing method for improving print quality. The printer minimizes the visually perceptible effect of dot placement errors, dot size errors, and dot shape errors on a printed medium due to depositing drops of ink from lower print quality printhead nozzles. The printer provides a sensor which can test the ink drop output of the printhead nozzles to determine, for each particular printhead installed in the printer, which nozzles are of higher print quality and which are of lower print quality. A printmask is then defined based on the results of the testing for use in printing from that printhead. The printmask has a mask pattern which enables the deposition of more ink from higher quality nozzles and less ink from lower quality nozzles. Such a printer improves print quality without reducing throughput.

42 Claims, 7 Drawing Sheets

DIRECTIONALITY
(DOT PLACEMENT)
ERROR

DOT VOLUME OR
DOT SIZE ERROR

DOT SHAPE ERROR

CUSTOMIZING PRINTMASKS FOR PRINTHEAD NOZZLE ABERRATIONS

CROSS-REFERENCE TO RELATED APPLICATIONS

This application relates to the subject matter disclosed in the co-pending U.S. application Ser. No. 08/810,467, by Kumar et al., filed Mar. 4, 1997, titled "Dynamic Multi-Pass Print Mode Corrections to Compensate for Malfunctioning Inkjet Nozzles"; the co-pending U.S. application Ser. No. 08/811,412, by Armijo et al., filed Mar. 4, 1997, titled "Detection of Printhead Nozzle Functionality by Optical Scanning of a Test Pattern"; the co-pending U.S. application Ser. No. 09/399473 by Askeland, filed concurrently herewith, titled "Banding Reduction in Multipass Printing"; and the co-pending U.S. application Ser. No. 09/399534 by Bland et al., filed concurrently herewith, titled "Hybrid Printmask for Multidrop Inkjet Printer"; all of which are assigned to the assignee of the present invention and hereby incorporated by reference in their entirety.

FIELD OFF THE INVENTION

The present invention relates generally to modes of printing with swath-type printing systems. It relates more particularly to printmodes for improving the print quality of output produced by individual printheads used in an inkjet printer.

BACKGROUND OF THE INVENTION

Inkjet printers, and thermal inkjet printers in particular, have come into widespread use in businesses and homes because of their low cost, high print quality, and color printing capability. The operation of such printers is relatively straightforward. In this regard, drops of a colored ink are emitted onto the print media such as paper or transparency film during a printing operation, in response to commands electronically transmitted to the printhead. These drops of ink combine on the print media to form the text and images perceived by the human eye. Inkjet printers may use a number of different ink colors. One or more printheads may be contained in a print cartridge, which may either contain the supply of ink for each printhead or be connected to an ink supply located off-cartridge. An inkjet printer frequently can accommodate two to four print cartridges. The cartridges typically are mounted side-by-side in a carriage which scans the cartridges back and forth within the printer in a forward and a rearward direction above the media during printing such that the cartridges move sequentially over given locations, called pixels, arranged in a row and column format on the media which is to be printed. Each print cartridge typically has an arrangement of printhead nozzles through which the ink is controllably ejected onto the print media, and thus a certain width of the media corresponding to the layout of the nozzles on the print cartridge, can be printed during each scan, forming a printed swath. The printer also has a print medium advance mechanism which moves the media relative to the printheads in a direction generally perpendicular to the movement of the carriage so that, by combining scans of the print cartridges back and forth across the media with the advance of the media relative to the printheads, ink can be deposited on the entire printable area of the media.

The quality of the printed output is a very important feature to purchasers of inkjet printers, and therefore manufacturers of inkjet printers pay a great deal of attention to providing a high level of print quality in their printers.

Aberrations in the printhead nozzles can undesirably reduce print quality; such aberrations include, for example, not ejecting ink at all, ejecting an incorrect volume of ink in a drop, producing irregularly shaped drops with artifacts such as tails, or producing a spray of extraneous droplets in addition to the desired drop. Another common type of nozzle aberration is directionality error, also known as dot placement error, in which the drops of ink are not precisely printed in the intended locations on the print media. While sometimes printhead aberrations are due to the design of the printhead and thus are similar for all printheads of that particular type, other times the nozzle aberrations for a particular type of printhead differ from printhead to printhead. In addition, printhead aberrations can develop over time and with usage of the printhead; for instance, nozzles can become clogged or wear.

Nozzle aberrations frequently result in banding, or streaks of unprinted areas, on the printed output. To minimize banding due to nozzle aberrations (and coincidentally to also reduce the effect of printing defects resulting from having too much ink on the print medium at one time, such as bleeding of one color area into another and warping or wrinkling of the print media), most printers do not print all the required drops of all ink colors in all pixel locations in the swath in one single scan, or "pass", of the printheads across the media. Rather, multiple scans are used to deposit the full amount of ink on the media, with the media being advanced after each pass by only a portion of the height of the printed swath. In this way, areas of the media can be printed in on more than one pass. In a printer which uses such a "multipass" printing mode, only a fraction of the total drops of ink needed to completely print each section of the image is laid down in each row of the printed medium by any single pass; areas left unprinted are filled in by one or more later passes. When printing of a page is complete, every area of the print medium has typically been printed on by the same multiple number of passes. Because each pass uses a different nozzle to print a particular row of the image, multipass printing can compensate for nozzle defects. However, the typical multipass printmode in which all nozzles are enabled to deposit substantially the same amount of ink on each row of pixels is often insufficient to improve print quality to an acceptable level, particularly when some nozzles have worse errors than others, as in the case of nozzle aberrations as described above.

One approach to overcoming the shortcomings of multipass printing for compensating for nozzle aberrations is disclosed in commonly-assigned U.S. Pat. No. 5,124,720 filed Aug. 1, 1990 and issued to Schantz on Jun. 23, 1992 and titled "Fault-Tolerant Dot-Matrix Printing", which is hereby incorporated by reference in its entirety. This approach improves print quality by compensating for malfunctioning nozzles on a printhead-by-printhead basis. This method tests the printhead to identify inoperative printing elements, and then alters the scan path of the printhead so that properly functioning printing elements print where the inoperative printing elements normally would have. However, this method reduces the throughput (the number of pages that can be printed in a given unit of time, such as pages per minute) because it decreases the distance the paper is advanced after each pass of the printhead and thus increases the number of passes required to fully print a page.

Throughput is often just as important or more important to an inkjet printer purchaser as is print quality. Accordingly, there is still a need for an inkjet printer that minimizes print quality defects due to nozzle aberrations but without significantly reducing the throughput of the printer.

SUMMARY OF THE INVENTION

In a preferred embodiment, the present invention provides a multipass inkjet printer that improves the quality of the printed output by compensating for dot placement error, dot shape error, and dot size error without compromising printing throughput. An embodiment of the printing system according to the present invention includes a printhead mounted in a carriage which is attached to a frame for relative motion with respect to a print medium. The printhead has an arrangement of nozzles, each having a print quality, through which ink is ejected onto a pixel grid of multiple rows on the print medium, each nozzle capable of depositing the drops of the ink onto a corresponding one of the rows during individual ones of the multiple printing passes. The printer also contains a print controller which activates the nozzles to deposit the ink onto the medium during each printing pass, as governed by a printmask. The printer further has the capability to test the nozzle print quality of individual printheads installed in the printer, and the capability to define the printmask such that it enables more printing from higher quality nozzles and less printing from lower quality nozzles in at least some of the rows. In some embodiments, the capability to test the printhead nozzle print quality may be implemented by a test pattern printed on the medium which is optically scanned by a sensor to detect nozzle quality. In alternate embodiments, the printhead is tested using either a pass-through detector inserted into the path through which ink drops are deposited onto the media, or an impact detector on which deposited ink drops impinge during a test operation. These detectors can be optical, piezoelectric, electrostatic, or other technology detector. In some embodiments, the capability to define the printmask may be implemented by a nozzle quality memory preferentially mounted on the printhead which stores indicia of nozzle quality, a processor which defines a printmask which allocates the ink deposition between higher and lower quality nozzles so as to improve the print output quality, and a printmask memory which stores the defined printmask. In some embodiments, the printmask has a hybrid mask pattern which uses a "hi-fipe" mode for lower quality nozzles and a "multidrop" mode for higher quality nozzles, while in other embodiments the printmask has a mask pattern which allows higher quality nozzles to print more possible times on a row than lower quality nozzles.

The present invention may also be implemented as a method of multipass printing. The method preferably includes providing a printhead for depositing ink onto a print medium, testing the printhead to identify lower print quality nozzles and higher print quality nozzles and allocating depositing of the ink between the lower quality nozzles and the higher quality nozzles based on the test results such that less than a given standard amount of ink from the lower print quality nozzles and more than a given standard amount of ink from the higher print quality nozzles is deposited in some rows. The testing can be performed during the printhead manufacturing process, during the printhead refilling process, after installation of the printhead in the inkjet printing system, and periodically during operation of the inkjet printing system. In some embodiments, the method also includes moving the printhead and the print medium relative to each other in a scan direction during each of the multiple passes, depositing the ink from certain nozzles onto pixel locations in certain rows as governed by the printmask while moving along the scan axis during each of the multiple passes, and moving the printhead and the print medium relative to each other in a medium advance direction in-between the multiple passes in order to position different nozzles over the certain rows. In some embodiments, allocating deposition of the ink includes defining a printmask which enables certain of the lower print quality nozzles identified by the testing to deposit the ink a relatively fewer total number of possible times during the multiple passes, and enables certain of the higher print quality nozzles to deposit the ink a relatively greater total number of possible times during the multiple passes. In other embodiments, allocating deposition of the ink includes defining a printmask which enables certain of the lower print quality nozzles identified by the testing to each deposit a small number of drops of the ink into specified pixel locations on at least two different rows during at least two corresponding passes, and enabling certain of the higher print quality nozzles to each deposit many drops of the ink rapidly into specified pixel locations on a given row during at least one of the multiple passes.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 1:
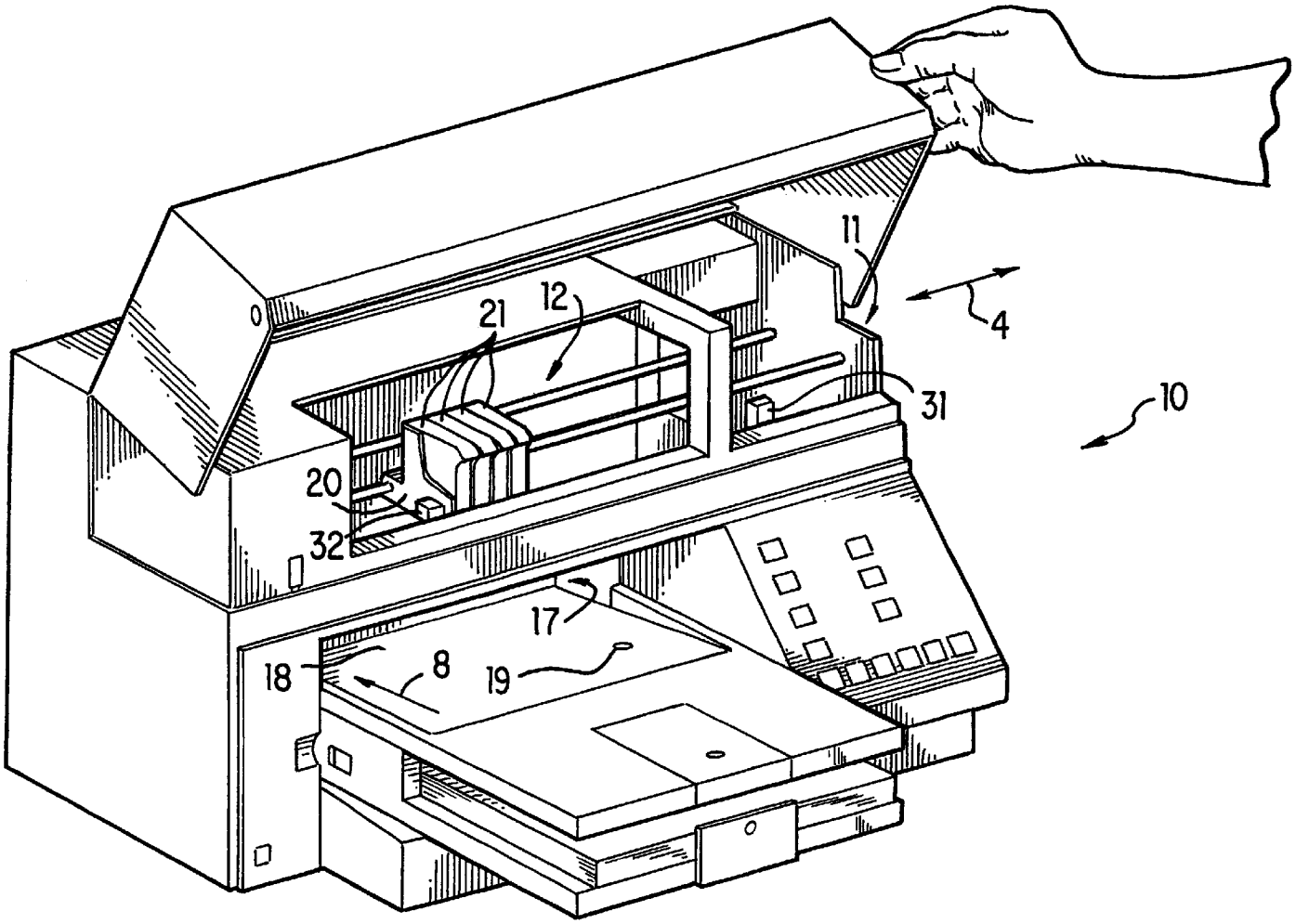
FIG. 1 is a perspective view of an inkjet printer embodying the present invention.
Figure 2:
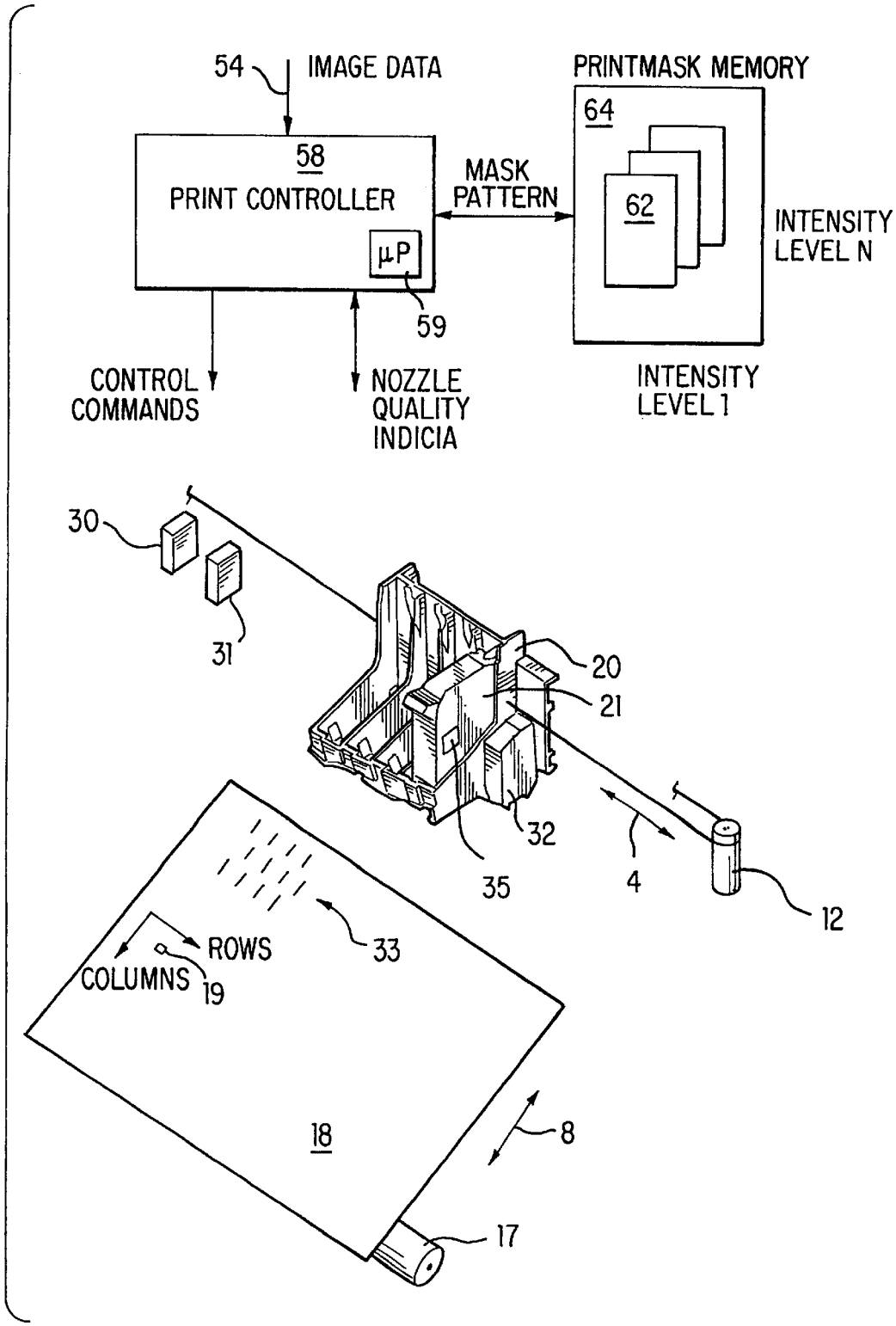
FIG. 2 is a schematic diagram of the major writing system sections of the inkjet printer of FIG. 1.
Figure 3:
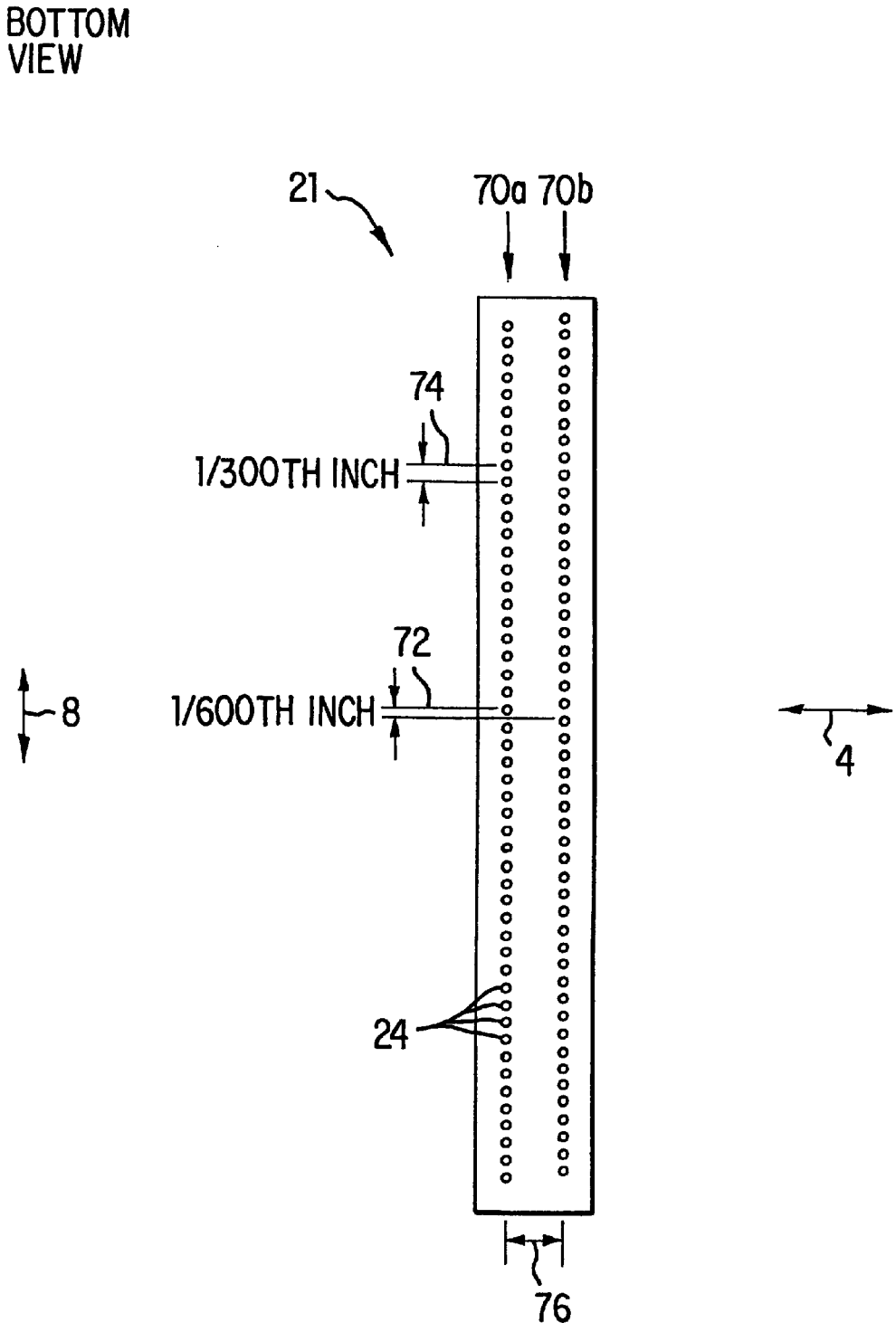
FIG. 3 is a schematic diagram of the nozzle arrangement of a printhead usable with the printer of FIG. 1.

Referring now to the drawings, and more particularly to FIGS. 1, 2, and 3, there is illustrated a printer 10 constructed in accordance with the present invention which reduces visually objectionable print quality defects that occurs due to nozzle aberrations, and does so without reducing printer throughput. A preferred embodiment of the printer 10 includes a frame indicated generally at 11 on which a carriage 20 is moveably mounted. The carriage 20 has stalls for holding at least one printhead 21 (FIG. 1 illustrates by way of example four printheads 21) and transporting them in a printing orientation adjacent the surface of a print medium 18 having a plurality of pixel locations, such as pixel location 19, organized in a rectangular array of rows and column. The carriage 20 is mounted in the frame 11 for relative motion with respect to the print medium 18 during a printing pass. Each printhead 21 has a plurality of nozzles 24 through which drops of ink are ejected onto the print medium 18 to form printed output, which may contain any combination of text, graphics, or photographs. As will be discussed hereinafter in further detail, the plurality of nozzles 24 is logically arranged as a linear array of nozzles substantially orthogonal to a scan axis 4, such that each nozzle is capable of depositing the drops of the ink onto a corresponding one of the rows of pixel locations during individual ones of the printing passes. The term "printing pass", as used herein, refers to those passes in which the printhead is enabled for printing as the nozzle arrangement 24 moves relative to the medium 18 in the scan axis direction 4; in a bidirectional printer 10, each forward and rearward pass along the scan axis 4 can be a printing pass, while in a unidirectional printer printing passes can occur in only one of the directions of movement during each printing pass. Each printhead 21 contains a different color ink, typically the subtractive primary colors magenta, cyan, and yellow; other color shades are formed by depositing drops of these different colors in the same or nearby pixels (there is also usually a separate black ink printhead for producing a richer color black than is achieved by mixing the subtractive primary colors, and for producing some of the darker shades of other colors). The carriage 20 is moveable along the scan axis 4 by a carriage advance mechanism, indicated generally at 12, mounted within the frame 11. The printer 10 also has a print medium advance mechanism, indicated generally at 17, mounted within the frame 11 which advances the print medium 18 along a medium advance axis 8 so as to change the row of pixel locations on which an individual nozzles prints. (The carriage advance mechanism 12 and the print medium advance mechanism 17 are well known to those skilled in the art, and will not be discussed further hereinafter.) A print controller 58 controls the carriage 20 and media 18 movements and is electrically connected to the printhead so as to activate the nozzles 24 for ink drop deposition. By combining the relative movement of the carriage 20 along the scan axis 4 with the relative movement of the print medium 18 along the medium advance axis 8, each printhead 21 can deposit one or more drops of ink at each individual one of the pixel locations 19 in the rows on the print medium 18. A printmask 62 is used by the print controller 58 to govern the deposition of ink drops from each printhead 21 during each of the multiple passes. Typically a separate printmask 62 exists for each discrete intensity level (eg. light to dark) of each different color printhead. For each pixel position 19 in a row during an individual printing pass, the printmask 62 has a mask pattern which both (a) acts like a "gate" to enable the nozzle positioned adjacent the row to print, or disable that nozzle from printing, on that pixel location 19, and (b) defines the number of ink drops to be deposited from enabled nozzles. Whether or not the pixel location will actually be printed on by the corresponding enabled nozzle as it passes over depends on whether the image data 54 to be printed requires ink of that color in that pixel location.

As will be discussed in greater detail subsequently, a printer 10 according to the present invention also has the capability to test each of the nozzles 24 of each printhead 21 to determine whether or not they are functioning properly, and consequently to assign indicia of print quality for each nozzle. Such a printer 10 also has the capability to construct for each individual printhead 21 a printmask 62 based on knowledge of the print quality of each nozzle which will improve the quality of the printed output without reducing throughput; this will also be subsequently discussed in further detail. The printmask 62 is constructed to have a printmask pattern such that less ink from lower print quality nozzles and more ink from higher print quality nozzles is enabled to be deposited in at least some rows of the pixel locations 19 on the print medium 18. The less ink and the more ink are relative to a given standard amount of ink. Typically this standard amount is a substantially equal amount of ink from each nozzle.

Figure 4A:
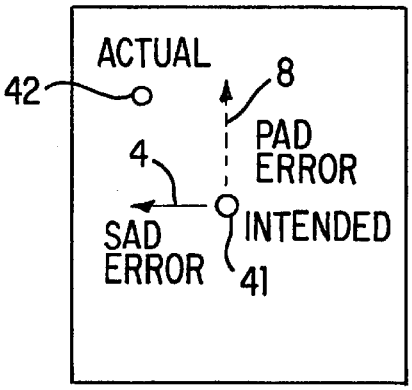
FIGS. 4A–4C are schematic diagrams illustrating the types of nozzle aberration errors (directionality error, dot volume error, and dot shape error respectively) that affect the print quality achievable with the printer of FIG. 1.
Figure 4B:
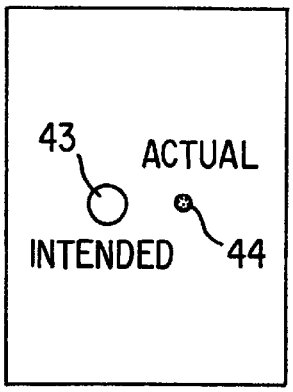
Figure 4C:
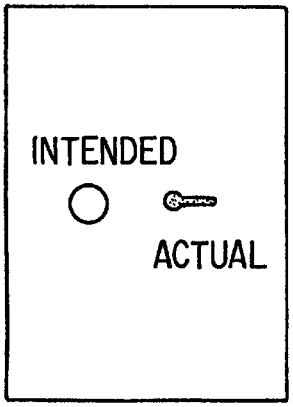

Before discussing the nozzle testing and printmask construction in further detail, however, it is beneficial to consider with reference to FIGS. 4A through 4C several types of nozzle aberrations known to those skilled in the art and for which the present invention can compensate. FIG. 4A illustrates by way of example directionality error (also known as dot placement error). A nozzle 24 exhibiting directionality error does not deposit ink drops precisely in the intended location 41, but rather places them in an actual location 42 different from the intended location 41 by some amount of directionality error. This directionality or dot placement error may have a component in the direction of the scan axis 4 (known as scan axis directionality, or SAD, error), and a component in the direction of the media or paper advance axis 8 (known as paper axis directionality, or PAD, error). Embodiments of the present invention can improve the print quality produced from printheads which exhibit either SAD, PAD, or both SAD and PAD. FIG. 4B illustrates by way of example dot size error (dot volume error). A nozzle 24 exhibiting dot size error deposits an actual amount of ink 44 different from the intended amount of ink 43 (in the illustration, the actual amount of ink 44 is less than the intended amount 43, as might occur using a weak or clogged nozzle). FIG. 4C illustrates by way of example dot shape error. A nozzle 24 exhibiting dot shape error deposits ink in an actual pattern 46 which is not substantially circular as intended 45. The actual pattern 46 can include non-circular shapes, tails, and spray.

As is well known to those skilled in the art, printheads are typically formed on silicon substrates. One or more printheads, each for a different ink, may be formed on a single substrate. Considering now the plurality of nozzles 24 of a printhead 21 in greater detail with reference to FIG. 3, a preferred embodiment of a printhead 21 has two vertical columns 70*a–b* of nozzles 24 which, when the printhead 21 is installed in the printer 10, are perpendicular to the scan axis 4. The columnar vertical spacing 74 between adjacent nozzles in a column is typically 1/300th inch in present-day printheads. However, by using two columns instead of one and logically treating the nozzles as a single column, the effective vertical spacing 72 between logical nozzles is reduced to 1/600th inch, thus achieving improved printing resolution in the direction of the media advance axis 8. As an illustration, the print controller 58 would print a vertical column of 1/600th inch pixel locations on the print medium 18 by depositing ink from the nozzles in column 70*a*, then moving the printhead 21 in the scan axis direction 4 an amount equal to the inter-column distance 76 before depositing ink from the nozzles in column 70*b*.

Returning now to the means for testing the printhead nozzles 24 to determine the print quality of each, the present invention contemplates the use of a wide variety of different detectors, also known as sensors, for measuring the quality of the ink drops deposited from the nozzles. One preferred embodiment includes an in-flight passthrough sensor 30 which detects and characterizes ink drops in flight as the drops pass through the sensor 30. The sensor 30 can be mounted in the frame 11 such that the carriage 20 positions the nozzles 24 of the printhead 21 in a test position, or alternatively can be mounted on the carriage 20 between the printhead 21 and the media 18 in the path of deposited ink drops such that the ink drops pass through the sensor 30 during normal printing operation (not shown). Nozzle quality is determined based on the detection and characterization of ink drops from the selected nozzle. The in-flight detector 30 may be implemented using a number of technologies known to those skilled in the art, including optical and electrostatic technologies. Optical in-flight detectors usable with the present invention are described in greater detail in U.S. Pat. No. 4,922,270, filed Jan. 31, 1989 and issued May 1, 1990 to Cobbs et al., and U.S. Pat. No. 5,434,430, filed Apr. 30, 1993 and issued Jul. 18, 1995 to Stewart, both of which are assigned to the assignee of the present invention and are hereby incorporated by reference in their entirety. Examples of electrostatic in-flight detectors usable with the present invention are described in U.S. Pat. No. 3,953,860 issued Apr. 27, 1976 to Fujimoto et al., titled "Charge Amplitude Detection for Ink Jet System Printer".

Another preferred embodiment includes an impact sensor 31 which detects and characterizes ink drops on impact as the drops strike the sensor 31. The sensor 31 can be mounted in the frame 11 such that the carriage 20 positions the nozzles 24 of the printhead 21 in a test position. Nozzle quality is determined based on the detection and characterization of ink drops from the selected nozzle. The impact detector 31 may be implemented using a number of technologies known to those skilled in the art, including piezoelectric and electrostatic technologies. Use of a piezoelectric membrane impact detector suitable for use with the present invention is described in greater detail in U.S. Pat. No. 5,124,720, filed Aug. 1, 1990 and issued Jun. 23, 1992 to Schantz, titled "Fault-Tolerant Dot-Matrix Printing", which is assigned to the assignee of the present invention and hereby incorporated by reference in its entirety. Examples of electrostatic impact detectors usable with the present invention are described in U.S. Pat. No. 4,323,905 issued Apr. 6, 1982 to Reitberger et al., titled "Ink Droplet Sensing Means".

Yet another preferred embodiment for testing the printhead nozzles 24 uses an ink drop test pattern 33 printed on the print medium 18 from the nozzles 24. This embodiment includes a print sensor 32 mounted on the carriage 20 for relative motion with respect to the print medium 18. After the test pattern 33 is printed, the carriage 20 moves the sensor 32 over the print medium 18 in one or more sensing passes in order to scan and analyze the test pattern 33 so as to determine the print quality of the nozzles 24. One type of print sensor 32 that is usable with the present invention is an optically reflective sensor, such as is described in greater detail in the above-referenced copending U.S. application Ser. No. 08/811,412, by Armijo et al., filed Mar. 4, 1997, titled "Detection of Printhead Nozzle Functionality by Optical Scanning of a Test Pattern". Further details of how the various types of sensors described above are used to test the printhead will be discussed subsequently.

Figure 5:
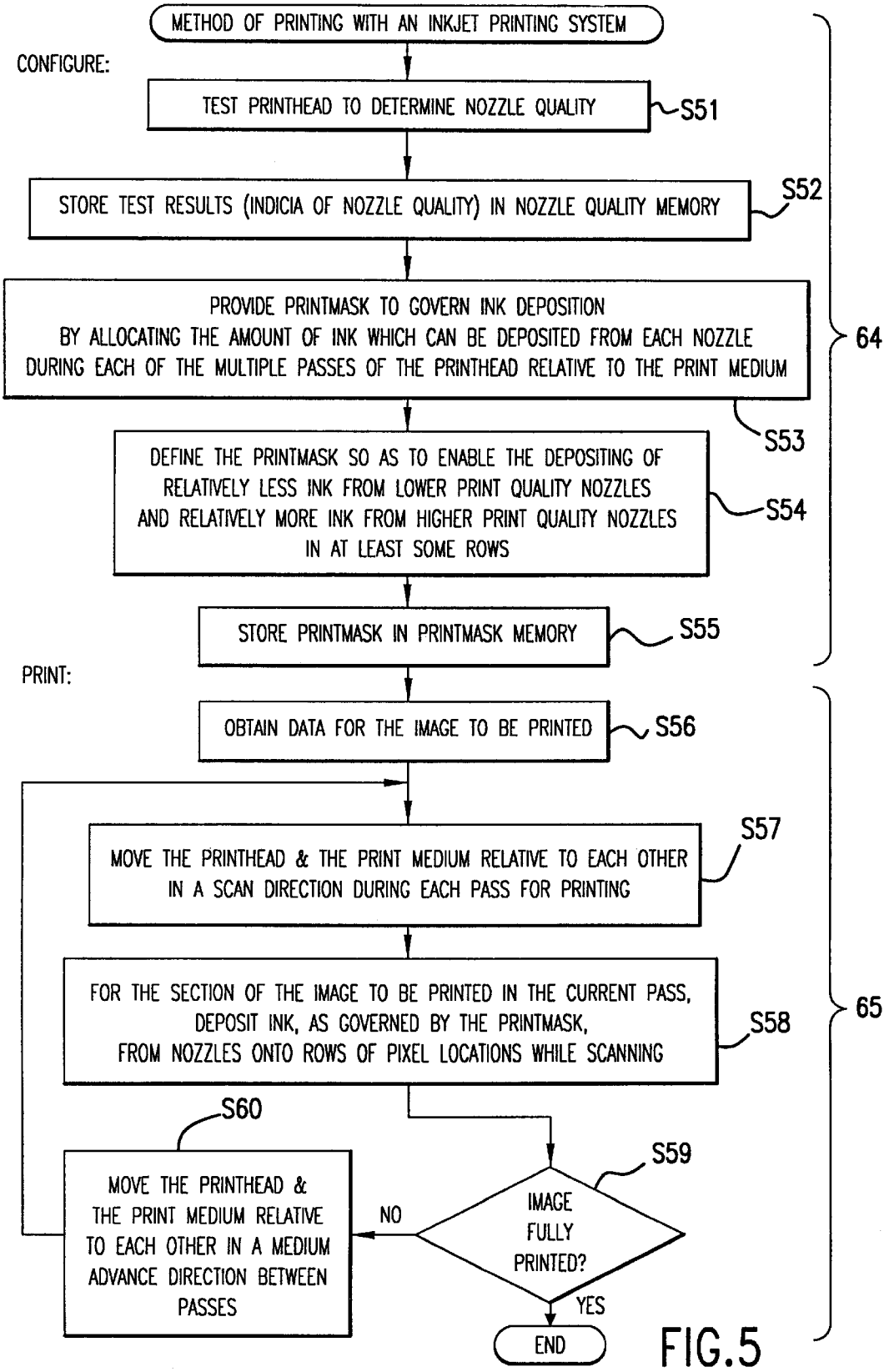
FIG. 5 is a flowchart of a method of printing with the multipass inkjet printer of FIG. 1 so as to compensate for specific nozzle aberrations of an individual printhead without reducing throughput.

Considering now a method of printing with an inkjet printer 10 according to the present invention, and with reference to FIG. 5, the method includes both (a) a configuration portion 64 that configures a printmask 62 for each printhead 21 of the printer 10 in order to maximize the quality of the printed output, by minimizing print quality defects that occur due to nozzle aberrations but without significantly reducing the throughput of the printer 10, and (b) a printing portion 65 which uses the configured printmask to print an image on the printer 10.

The configuration portion 64 begins with a step S51 which tests the printhead 21 to determine the print quality of the nozzles 24. This testing uses the above-mentioned sensors to determined the nozzle quality; the testing method will be described subsequently in greater detail.

In step S52, the test results generated in step S51 are stored in a nozzle quality memory 35. The memory 35 is readable and writeable by a processor 59 operatively connected to the print controller 58. The test results represent indicia of nozzle quality. The preferred indicia include identifying individual nozzles 24 as capable of generating output of either higher or lower print quality, or assigning nozzles a value of one of N levels of print quality. Alternatively, sections of the printhead 21 containing groups of nozzles may be identified as capable of generating output of either higher or lower print quality. In a preferred embodiment, a separate memory 35 is used for storing the indicia of nozzle quality for each printhead 21, and this memory 35 is preferentially incorporated in each printhead 21. A memory incorporated in the printhead that is usable with the present invention is described in greater detail in U.S. Pat. No. 5,812,156, filed Jan. 21, 1997 and issued Sep. 22, 1998 to Bullock et al., titled "Apparatus Controlled by Data from Consumable Parts with Incorporated Memory Devices", which is assigned to the assignee of the present invention and hereby incorporated by reference in its entirety. Alternatively, the memory 35 may be located in the printer 10, or in a computer (not shown) which is connectable to the printer 10.

In step S53, a printmask 62 to govern ink deposition is provided. The printmask 62 allocates the amount of ink which can be deposited from each nozzle 24 during each of the multiple printing passes of the printhead 21 relative to the print medium 18. The printmask 62 is defined, as described in step S54, so as to enable the depositing, in at least some rows of pixel locations on the print medium 18, of relatively less ink from lower print quality nozzles, and relatively more ink from higher print quality nozzles. The processor 59 performs the computation and control operations required to define the printmask. Details of a method according to the present invention to perform this allocation will be described subsequently in further detail.

In step S55, once the printmask 62 is constructed, it is stored in a printmask memory 64 which is operatively connected to the processor 59 and the print controller 58. In a preferred embodiment, the printmask memory 64 is mounted within the frame of the printer 10. Alternatively, the printmask memory 64 may be stored external to the printer 10, for example in a computer (not shown) which is attachable to the printer 10.

The printing portion 65 begins with a step S56 in which all or part of the image to be printed on the printer 10 is obtained. It is to be understood that the term "image" refers not only to pictures or photographs, but to any information to be output to the print medium 18, including graphics or text.

In step S57, the printhead 21 and the print medium 18 move in relative motion in the scan direction 4 during each printing pass. For each section of the image which corresponds to the position of the printhead 21 over the print medium 18, nozzles 24 deposit ink, as governed by the printmask 62 for the printhead 21, onto corresponding rows of pixel locations on the print medium 18 during the scanning operation, as indicated in step S58.

In step S59, if the image has been completely printed, the printing operation ends. If some of the image remains to be printed, then step S60 is performed, in which the the printhead 21 and the print medium 18 move in relative motion in the medium advance direction 8 between passes so as to position a different swath of the medium 18 under the printhead 21. Following step S60, the method then continues at step S57.

The testing (S51) and storing (S52) steps of the above-mentioned method as illustrated in FIG. 5 can be performed at different times, including outside the printer (for example, using a test system designed for testing printheads) during the manufacturing process for the printhead 21, during a process of refilling a previously manufactured printhead 21 with ink, after installation of the printhead 21 in the printer 10 of an inkjet printing system, and periodically in the printer during operation of the inkjet printing system. In a similar fashion, the steps of providing a printmask (S53) and defining the printmask (S54) can be performed following the completion of steps S51 and S52, or can be deferred to a later time prior to printing.

Figure 6:
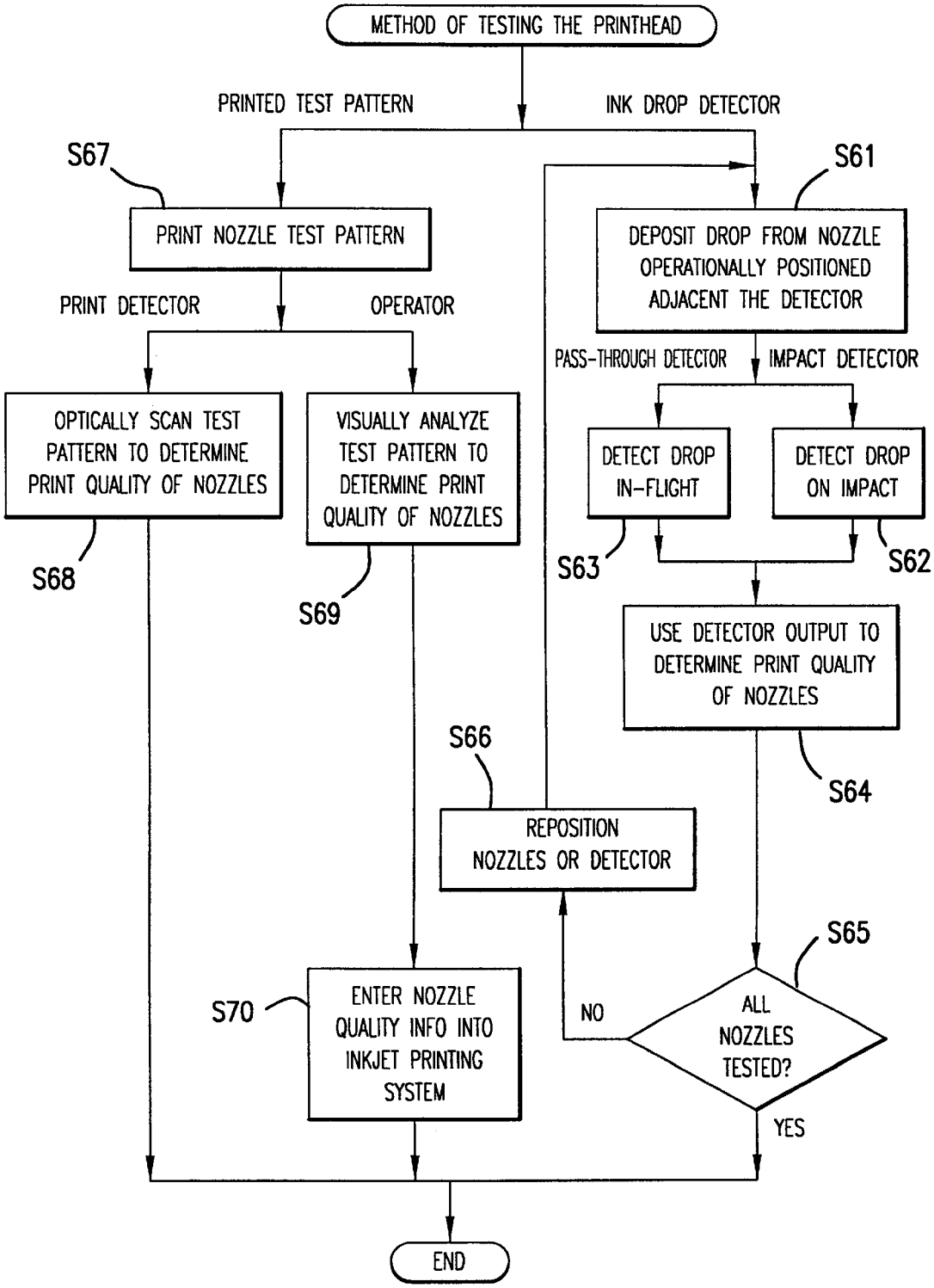
FIG. 6 is a flowchart of a method for testing a printhead to determine nozzle quality as performed in the method of FIG. 5.

Considering now in further detail the method of testing the printhead of step S51, and as best understood with reference to FIG. 6, the steps of this method depend on the type of detection operation to be performed. A preferred method which determines nozzle quality by assessing ink drops as they are deposited begins with a step S61 which deposits one or more drops from a nozzle which is operationally positioned adjacent the sensor. For an impact sensor 31, the nozzle is positioned such that ink drops from the nozzle will strike the sensor 31 to create its output on impact, as in step S62. For an in-flight pass-through sensor 30, the nozzle is positioned such that the ink drops from the nozzle will pass through an opening in the sensor 30 to break a light path and create its output, as in step S63. A number of alternatives for positioning the sensor are contemplated by the present invention. A single sensor can be repositioned to detect and analyze a number of different nozzles, a single sensor can be provided with a detecting area of sufficient size to assess multiple nozzles without movement, or a single sensor may have multiple detecting elements for measuring multiple nozzles. In step S64, the output of the sensor is used to determine the print quality of the corresponding nozzle. If all nozzles have been tested, then the "yes" branch of step S65 is taken and testing of the printhead is concluded. If all nozzles have not been tested, then the "no" branch of step S65 is taken; the printhead 21 or sensor is repositioned if necessary in step S66, and the method then continues at step S61.

An alternate method of testing the printhead determines nozzle quality by assessing the output on the medium 18 of a printed test pattern 33. This method begins with a step S67 in which a nozzle test pattern is printed on the medium 18. In a preferred embodiment, a single test pattern is printed to test all nozzles; one such test pattern usable with the present invention is described in further detail in the above-referenced co-pending U.S. application Ser. No. 08/811,412, by Armijo et al., filed Mar. 4, 1997, titled "Detection of Printhead Nozzle Functionality by Optical Scanning of a Test Pattern". If a print sensor is used to automate the assessment of nozzle quality, then the printed test pattern is scanned in step S68 in order to determine the print quality of the nozzles. Alternatively, if the determination of nozzle quality is to be visually made by the operator of the printer 10, then in step S69 the operator visually analyzes the test pattern to determine the print quality of the nozzles, and in step S70 enters the nozzle quality information into the inkjet printing system using, for example, the keyboard of a computer (not shown) which is connected to the printer 10, or a keypad mounted on the printer 10.

Figure 7:
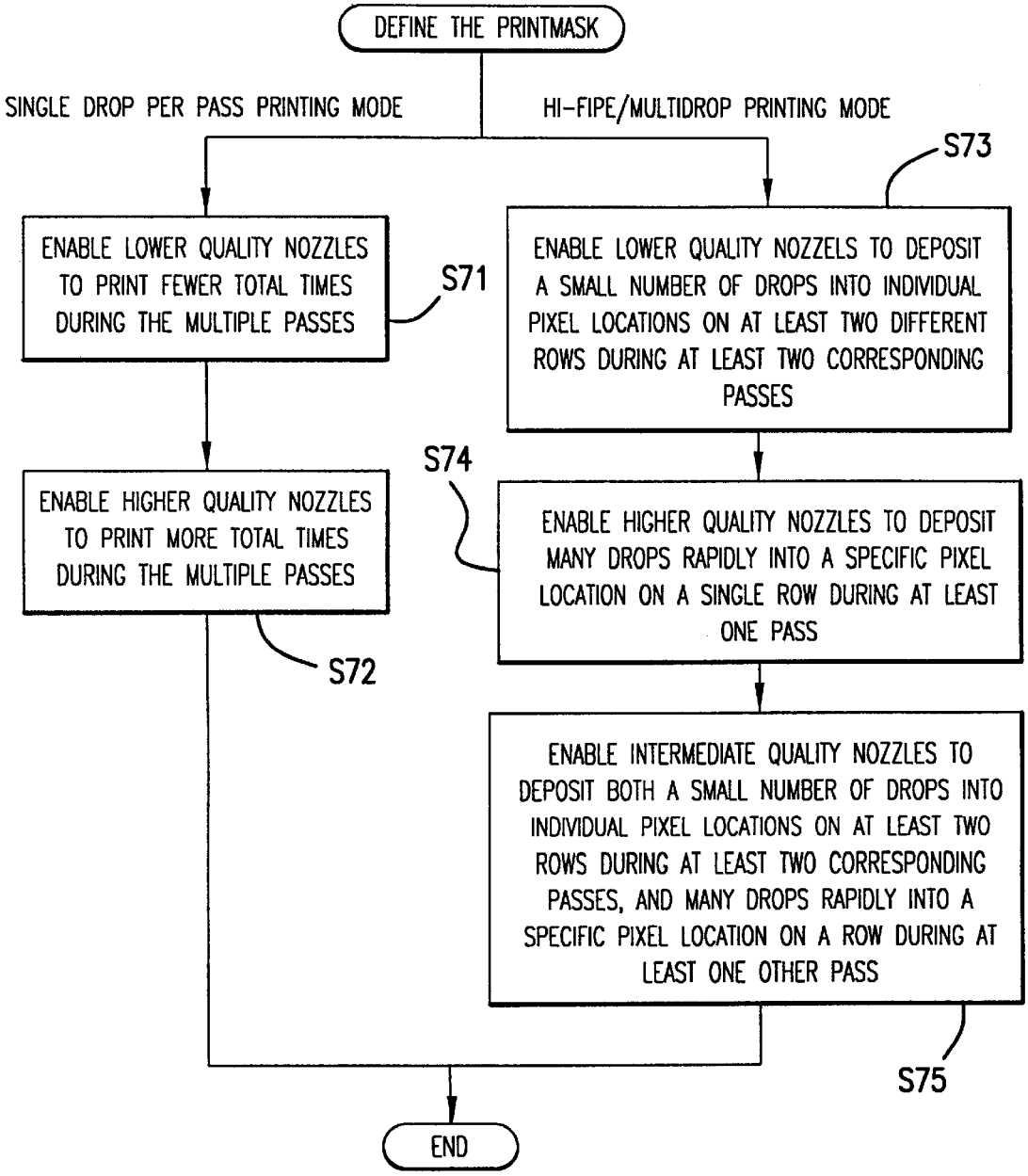
FIG. 7 is a flowchart of a method for defining the printmask pattern of FIG. 2 as performed in the method of FIG. 5.

Considering now in further detail step S54 of FIG. 5, FIG. 7 illustrates by way of example a method according to the present invention for defining the printmask 62 to enable the printing of less ink from lower quality nozzles and more ink from higher quality nozzles so as to improve print quality without reducing throughput. By way of introduction, different types of printers may provide different capabilities for printing a pixel location with a given intensity of a color ink. Some printers, particularly those which have relatively large drop volumes, or a relatively low repetition rate at which multiple drops can be deposited from a given nozzle, print a given pixel location with only a single drop in a given printing pass, and that single drop will provide the full amount of ink required to completely print that pixel location. Such a printer is described in the abovereferenced co-pending U.S. application by Askeland titled "Banding Reduction in Multipass Printing" (U.S. application Ser. No. 09/399473).

Alternatively, other printers, particularly those which have relatively small drop volumes such that several drops are required to provide the full amount of ink required to completely print a pixel location, and a relatively high repetition rate at which multiple drops can be deposited from a given nozzle, can print in different modes during the printing of a single image. In a first printing mode, known as "hi-fipe" mode, a nozzle deposits a small number of drops (typically one drop) into pixel locations on different rows during each of several passes. On a given pixel location on a given row, the nozzle provides only a fraction of the total amount of ink required to completely print the pixel location, and so additional drops must be deposited from other nozzles into the pixel location during other passes. In a second printing mode, known as "multidrop" mode, a nozzle prints a given location by depositing several drops (typically at least two drops) rapidly into a given pixel location in a small number of passes (typically one pass). Typically, the several drops completely print the pixel location during a single pass. Advantageously, some nozzles can operate in a hi-fipe mode while other nozzles operate in a multidrop mode. Such a printer is described in the abovereferenced co-pending U.S. application by Bland et al. titled "Hybrid Printmask for Multidrop Inkjet Printer" (U.S. application Ser. No. 09/399534).

Returning to the discussion of step S54 of FIG. 5 with reference to FIG. 7, different steps are performed depending on whether or not the printer is operated in a single drop per pass printing mode, or in a hybrid hi-fipe/multipass printing mode. If a single drop per pass printing mode is used, the printmask specifies the total number of possible times each of the nozzles can be activated during the multiple printing passes. The first step S71 in defining the printmask is to enable lower print quality nozzles identified by the testing to print relatively fewer possible total times during the multiple passes. Next, in step S72, higher print quality nozzles identified by the testing are enabled to print relatively more possible total times during the multiple passes, to compensate for the reduced amount of printing performed using the lower print quality nozzles. The relatively more possible total times and the relatively fewer possible total times are relative to a substantially equal number of possible times for all nozzles.

Following this step, the method ends. The resulting printmask 62, which has a mask pattern allowing some of the nozzles to deposit drops in fewer possible pixel locations on a row and allowing others of the nozzles to deposit drops in more possible pixel locations on the row, provides for an unequal printing load between higher and lower quality nozzles, with higher quality nozzles being enabled more total times on a row than lower quality nozzles. However, the proper number of total drops are enabled for printing on the row because a compensating higher quality nozzle will print during one pass on rows printed by lower print quality nozzles during a different pass. The structure and method of operation of a printmask 62 resulting from the execution of this method is described in the abovereferenced co-pending U.S. application by Askeland titled "Banding Reduction in Multipass Printing" (U.S. application Ser. No. 09/399473).

If a hybrid hi-fipe/multipass printing mode is used, the printmask 62 specifies the number of drops of the ink that each of the nozzles can deposit into the pixel locations during each of the multiple passes, where at least two drops of the ink are required to fully print a pixel location 62 with a given intensity level of color. The first step S73 in defining the printmask is to enable lower print quality nozzles identified by the testing to deposit a small number of drops into individual pixel locations on at least two different rows during at least two corresponding passes. Next, in step S74, higher print quality nozzles identified by the testing are enabled to deposit many drops rapidly into a specific pixel location on a single row during at least one pass. Optionally, nozzles defined to be of intermediate print quality can be enabled to deposit both a small number of drops into individual pixel locations on at least two rows during at least two corresponding passes, and many drops rapidly into a specific pixel location on a single row during at least one other pass. Following this step, the method ends. The resulting printmask 62, which has a hi-fipe mask subpattern for a some nozzles and a multidrop mask subpattern for other nozzles, provides for an equal printing load from higher and lower print quality nozzles; after completion of all passes, the higher and lower print quality nozzles will have been enabled to deposit substantially the same number of drops. However, because the lower print quality nozzles operate in a hi-fipe mode which limits their ink contribution to any specific pixel to a fraction of the total ink required to fully print that pixel, with other higher print quality nozzles contributing the remainder of the ink to that specific pixel by printing on it in different passes, the effect of erroneous printing from the lower print quality nozzles is more evenly distributed throughout the printed output, and consequently less visually perceptible. The structure and method of operation of a printmask 62 resulting from the execution of this method is described in the abovereferenced co-pending U.S. application by Bland et al. titled "Hybrid Printmask for Multidrop Inkjet Printer" (U.S. application Ser. No. 09/399534).

From the foregoing it will be appreciated that the printer and method provided by the present invention represents a significant advance in the art. A printer can be constructed according to the present invention so as to reduce visually objectionable banding that occurs due to nozzle aberrations occurring on individual printheads without significantly reducing printing throughput. Although several specific embodiments of the invention have been described and illustrated, the invention is not to be limited to the specific methods, forms, or arrangements of parts so described and illustrated. In particular, the invention may be used with bidirectional printing where printing passes occur in both directions of movement along the scan axis 4, or unidirectional printing where printing passes occur only in one direction along the scan axis 4; with even-advance printmodes where the medium 18 is advanced the same distance between passes, or with uneven-advance printmodes in which the medium 18 is advanced different distances between passes; with multipass printers requiring two or more passes to fully print rows on the print medium; with printmasks having any number of cells in width; with all types of swath printers including band printers and drum printers; with all types of inkjet printers including thermal and piezo printing technologies; and with printing systems in which all the components of the printer may not be located in the same physical enclosure. According to the present invention, a single sensor can be positioned to detect and analyze a number of individual nozzles; a single sensor can be designed to have a detecting area of sufficient size to detect multiple nozzles without movement; or a sensor may have multiple detecting elements for detecting the output of multiple nozzles. Also, the invention is usable with printheads having lower and higher print quality nozzles regardless of where on the printhead those nozzles are located. The invention is limited only by the claims.

What is claimed is:

1. A method of printing with an inkjet printing system using multiple passes over a print medium having rows of pixel locations, comprising:

providing a printhead having a supply of ink and a plurality of nozzles for depositing the ink onto the print medium, each of the nozzles depositing the ink onto a corresponding one of the rows during a single pass, with certain ones of the nozzles having a measurable print quality;

testing the printhead to generate test results which identify lower print quality nozzles and higher print quality nozzles; and allocating the depositing of the ink between the lower print quality nozzles and the higher quality nozzles based on the test results of the testing such that less than a given standard amount of ink from the lower print quality nozzles and more than a given standard amount of ink from the higher print quality nozzles is deposited in at least some rows, in order to improve the quality of printed output without reducing throughput.

2. The method of claim 1, wherein the testing the printhead includes conducting testing to identify nozzles which exhibit a substantial amount of at least one of the print quality defects of the group consisting of dot placement error, dot size error, and dot shape error.

3. The method of claim 1, wherein the given standard amount of ink used for the allocating is a substantially equal amount of ink from those individual ones of the plurality of nozzles which deposit the ink onto the corresponding one of the rows during any of the multiple passes.

4. The method of claim 1, further comprising:

storing the printmask in a memory.

5. The method of claim 1, wherein testing the printhead further includes:

printing a nozzle test pattern on the print medium; and optically scanning the nozzle test pattern to identify the lower print quality nozzles and higher print quality nozzles.

6. The method of claim 1, wherein testing the printhead further includes:

printing a nozzle test pattern on the print medium; and visually analyzing the nozzle test pattern to identify the lower print quality nozzles and higher print quality nozzles.

7. The method of claim 1, wherein testing the printhead further includes:

providing an ink drop detector positionable proximate individual ones of the nozzles;

depositing at least one drop of the ink from a selected individual one of the nozzles positioned proximate the ink drop detector;

detecting the at least one drop of the ink from the selected individual one of the nozzles using the ink drop detector, the detector providing an output; and determining the print quality of the selected individual one of the nozzles from the output of the ink drop detector.

8. The method of claim 7, wherein the detecting includes detecting the at least one drop in flight as the drop passes proximate the ink drop detector.

9. The method of claim 7, wherein the detecting includes detecting the at least one drop on impact when the ink drop strikes the ink drop detector.

10. The method of claim 1, wherein the testing includes performing the test at a time selected from the group consisting of: during the printhead manufacturing process, during the printhead refilling process, after installation of the printhead in the inkjet printing system, and periodically during operation of the inkjet printing system.

11. The method of claim 1, further including:

storing indicia for the lower print quality nozzles and the higher print quality nozzles in a memory.

12. The method of claim 11, wherein the storing indicia includes storing in a memory located in the printhead.

13. The method of claim 11, wherein the storing indicia includes storing in a memory located in the inkjet printer.

14. The method of claim 11, wherein the storing indicia includes storing in a computer connectable to the inkjet printer.

15. The method of claim 11, wherein the storing indicia includes storing nozzle numbers of the lower print quality nozzles.

16. The method of claim 11, wherein the storing indicia includes storing sections of the printhead containing the lower print quality nozzles.

17. A method of printing with an inkjet printing system using multiple passes over a print medium having rows of pixel locations, comprising:

providing a printhead having a supply of ink and a plurality of nozzles for depositing the ink onto the print medium, each of the nozzles depositing the ink onto a corresponding one of the rows during a single pass, with certain ones of the nozzles having a measurable print quality;

testing the printhead to generate test results which identify lower print quality nozzles and higher print quality nozzles;

providing a printmask to govern the depositing of the ink from each of the nozzles during the multiple passes, the printmask enabling the depositing in at least some rows of less ink from the lower print quality nozzles and more ink from the higher print quality nozzles based on the test results of the testing, the less ink and the more ink relative to depositing a given standard amount of ink, in order to improve the quality of printed output without reducing throughput.

18. The method of claim 17, further comprising:

moving the printhead and the print medium relative to each other in a scan direction during each of the multiple passes;

depositing the ink from individual ones of the nozzles onto pixel locations in the corresponding ones of the rows as governed by the printmask while moving along the scan axis during each of the multiple passes; and moving the printhead and the print medium relative to each other in a medium advance direction in between certain of the multiple passes in order to position different nozzles adjacent the corresponding ones of the rows.

19. The method of claim 17, wherein the providing a printmask to govern the depositing of the ink further includes specifying the total number of possible times each of the nozzles can be activated during the multiple passes.

20. The method of claim 19, wherein the providing a printmask to govern the depositing of ink further comprises:

enabling certain the lower print quality nozzles identified by the testing to deposit the ink a relatively fewer total number of possible times during the multiple passes so as to reduce the amount of printing performed using lower print quality nozzles; and enabling certain of the higher print quality nozzles identified by the testing to deposit the ink a relatively greater total number of possible times during the multiple passes in order to compensate for the reduced amount of printing performed using lower print quality nozzles.

21. The method of claim 20, wherein the enabling certain of the higher print quality nozzles further includes enabling at least one of the certain of the higher print quality nozzles to print during a certain single pass on at least one row which is also enabled to be printed on by at least one of the certain lower print quality nozzles during a different single pass.

22. The method of claim 20, wherein the providing a printmask further includes defining the relatively fewer total number of possible times and the relatively greater total number of possible times relative to a substantially equal number of possible times for all nozzles.

23. The method of claim 17, wherein the providing a printmask to govern the depositing of ink further includes specifying a number of drops of the ink that the nozzles can deposit into certain of the pixel locations on a row during each of the multiple passes, with at least two drops of the ink being required to fully print the pixel locations with a given intensity level.

24. The method of claim 23, wherein the providing a printmask to govern the depositing of ink further comprises:

enabling certain of the lower print quality nozzles identified by the testing to each deposit a small number of drops of the ink into specified pixel locations on at least two different rows during at least two corresponding passes; and enabling certain of the higher print quality nozzles identified by the testing to each deposit many drops of the ink rapidly into specified pixel locations on a given row during at least one of the multiple passes.

25. The method of claim 24, further comprising:

enabling at least some others of the nozzles to deposit both the small number of drops of the ink and the many drops of the ink.

26. The method of claim 24 wherein the providing a printmask to govern the depositing of ink further includes enabling the certain of the lower print quality nozzles and the certain of the higher print quality nozzles to deposit substantially the same total number of drops of the ink onto the print medium after completion of all the multiple passes.

27. The method of claim 24, wherein the enabling certain of the lower print quality nozzles to each deposit a small number of drops includes depositing a single drop.

28. The method of claim 24, wherein the enabling certain of the higher print quality nozzles to each deposit many drops includes depositing at least two drops.

29. The method of claim 17, wherein the testing includes performing the test at a time selected from the group consisting of: during the printhead manufacturing process, during the printhead refilling process, after installation of the printhead in the inkjet printing system, and periodically during operation of the inkjet printing system.

30. An inkjet printer using multiple passes over a print medium having rows of pixel locations, comprising:

a frame;

a carriage attached to the frame for relative motion with respect to the print medium;

a printhead mounted in the carriage, the printhead having nozzles through which drops of an ink are deposited onto the print medium, each nozzle capable of depositing the drops of the ink onto a corresponding one of the rows during individual ones of the multiple passes, each individual one of the nozzles further having a print quality;

a print controller operatively connected to the printhead for controllably activating the nozzles to deposit the drops of the ink onto the print medium;

a printmask operatively coupled to the print controller to govern the ejection of the drops of the ink from the nozzles during each of the multiple passes of the carriage relative to the print medium;

means for testing the printhead to identify lower print quality nozzles and higher print quality nozzles; and means for constructing the printmask to allocate the ink deposition between lower print quality nozzles and higher print quality nozzles such that less ink from lower print quality nozzles and more ink from higher print quality nozzles is deposited in at least some rows, the less ink and the more ink relative to depositing a substantially equal amount of ink from all nozzles in the at least some rows, in order to improve the quality of printed output without reducing throughput.

31. The inkjet printer of claim 30, wherein the means for testing the printhead includes an ink drop test pattern printed on the print medium by at least some of the nozzles.

32. The inkjet printer of claim 31, wherein the means for testing the printhead further includes a print sensor mounted on the carriage for passing over the rows of print medium, the print sensor operatively connected to the print controller to detect and characterize the ink drop test pattern in order to identify the lower print quality nozzles and higher print quality nozzles.

33. The inkjet printer of claim 30, wherein the means for testing the printhead includes a pass-through detector mounted in the printer such that the ink drops from selected ones of the nozzles pass proximate the pass-through detector during ink drop deposition, the optical detector further operatively connected to the print controller to detect and characterize ink drops from selected ones of the nozzles in flight.

34. The inkjet printer of claim 30, wherein the means for testing the printhead includes an impact detector mounted in the printer such that the ink drops from selected ones of the nozzles strike the ink drop detector during a test operation, the impact detector further operatively connected to the print controller to detect and characterize individual ones of the ink drops when they strike the impact detector.

35. The inkjet printer of claim 33, wherein the pass-through detector is selected from the group consisting of an optical detector and an electrostatic detector.

36. The inkjet printer of claim 34, wherein the impact detector is selected from the group consisting of a piezoelectric detector and an electrostatic detector.

37. The inkjet printer of claim 30, wherein the printmask further includes:

a hi-fipe mask subpattern enabling a first group of the nozzles to deposit into a specific pixel location a small number of drops in each of several of the passes; and a multidrop mask subpattern enabling a second group of the nozzles to deposit into a specific pixel location many drops rapidly during at least one of the passes.

38. The inkjet printer of claim 30, wherein the printmask further includes a mask pattern allowing some of the nozzles to deposit the drops of the ink in fewer possible pixel locations of the corresponding ones of the rows in each pass, and allowing others of the nozzles to deposit the drops of the ink in more possible pixel locations of the corresponding ones of the rows in each pass.

39. The inkjet printer of claim 30, wherein the means for constructing the printmask includes:

a nozzle quality memory operatively connected to the print controller for storing indicia of the lower print quality nozzles and the higher print quality nozzles;

a processor operatively connected to the nozzle quality memory and the print controller for constructing the printmask based on the indicia so as to allocate the ink deposition between the lower print quality nozzles and the higher print quality nozzles; and a printmask memory operatively connected to the processor and the print controller for storing the printmask.

40. The inkjet printer of claim 39, wherein the nozzle quality memory is mounted on the printhead.

41. The inkjet printer of claim 39, wherein the printmask memory is mounted within the frame.

42. The inkjet printer of claim 32, wherein the print sensor is an optically reflective sensor.

* * * * *

UNITED STATES PATENT AND TRADEMARK OFFICE

CERTIFICATE OF CORRECTION

PATENT NO. : 6,278,469 B1
DATED : August 21, 2001
INVENTOR(S) : Bland et al.

It is certified that error appears in the above-identified patent and that said Letters Patent is hereby corrected as shown below:

Column 12,
Line 44, delete "storing the printmask in a memory" and insert in lieu thereof -- storing a printmask to govern the allocation of ink in a memory --.

Column 14,
Line 5, insert -- of -- between "certain" and "the".

Column 15,
Line 37, delete "print medium" and insert in lieu thereof -- pixel locations --.
Line 46, delete "the optical detector" and insert in lieu thereof -- the pass-through detector --.

Signed and Sealed this

Twelfth Day of March, 2002

*Attest:*

*Attesting Officer*

JAMES E. ROGAN
*Director of the United States Patent and Trademark Office*